United States Patent [19]

Stahl

[11] 4,209,115

[45] Jun. 24, 1980

[54] TWO-PART DELIVERY OUTLET CLOSURE FOR CONTAINERS

[75] Inventor: Otto Stahl, Finnentrop, Fed. Rep. of Germany

[73] Assignee: Georg Menshen & Co. KG, Finnentrop, Fed. Rep. of Germany

[21] Appl. No.: 940,017

[22] Filed: Sep. 6, 1978

[51] Int. Cl.[2] ..... B67D 3/00

[52] U.S. Cl. ..... 222/536; 251/352

[58] Field of Search ..... 222/531, 532, 533, 534, 222/536, 556; 137/616.7; 251/352

[56] References Cited

U.S. PATENT DOCUMENTS

| | | | |
|---|---|---|---|
| 3,023,939 | 3/1962 | Gustafson | 222/536 |
| 3,089,626 | 5/1963 | Kubiliunas | 222/536 X |
| 3,251,516 | 5/1966 | Thomas | 222/536 |
| 4,015,756 | 4/1977 | Beck | 222/536 X |

*Primary Examiner*—David A. Scherbel

*Attorney, Agent, or Firm*—Carella, Bain, Gilfillan & Rhodes

[57] ABSTRACT

A two-part delivery outlet closure device for containers, especially for liquids, including a cap part whose end wall is provided with a through bore leading into a recess which has two side walls wherein a rocking lever, which is also provided with an axial through bore, is pivotally mounted by a bearing system including a pair of bearing pins normal to the bores, one on each side thereof, and a pair of latch slots each adapted to receive one pin and open on one side and of narrower width in this region to the diameter of the bearing pin so that the pins are adapted to engage in the slots in the manner of a snap fastening, for which reason at least one part of the device is made of a resilient material, and the bearing pins being arranged in the side walls of the cap part and the latch slots on the lever part.

3 Claims, 3 Drawing Figures

TWO-PART DELIVERY OUTLET CLOSURE FOR CONTAINERS

This invention concerns a two-part delivery outlet closure for containers, especially for liquids, comprising a cap part whereof the end wall is provided with a through-bore leading into a recess which has two side walls wherein a rocker lever, which is likewise provided with an axial through-bore, is mounted for pivotal movement by means of a bearing system comprising a pair of bearing pins which extend normal to the bores one on either side thereof, and a pair of bearing or latch slots, each adapted to receive one of said pins and each open on one side, the width of said slots in this region being narrower than the diameter of the pins so that the pins can be engaged in the slots in the manner of a snap fastening, for which reason at least one part of the closure is made of a resilient material.

In an existing closure device of the kind specified the bearing pins are arranged on the rocking lever and correspondingly the upwardly open slots which are narrower in this region than the diameter of the pins are provided in the side walls of the recess in the end face of the cap part. The snap-engagement between the pins and the slots is designed not only to provide a releasable connection between the two parts of the closure device but also to press the lever into the cap recess with appropriate bias so that in the operative closing position of the device, wherein the lever is normal to the axis of the bore in the cap, the cylindrical peripheral face at the bottom end of the lever will be sealingly applied to the bore in the cap. However, since in the described existing arrangement the latch slots which are provided in the side walls of the recess must necessarily be open on the top side thereof, there can be only a slight amount of overlap for the bearing pins especially in the closed position of the device which means that even under comparatively low bias forces the pins are liable to be forced upwardly with the result that the lever is no longer pressed sufficiently strongly against the bore in the cap part of the device. This makes the device unreliable with regard to its sealing action and therefore useless.

In order to avoid the above described disadvantages another closure device of the type under consideration was designed wherein the two bearing pins, viewed in cross section, which are provided on the lever, are defined by two mutually opposite arcs of relatively different circumferential length and a pair of likewise mutually opposite sides which converge conically towards the bearing end of the rocking lever, and the correspondingly shaped pins are arranged in such a way that the shorter arc points to the interior of the container when the lever occupies the delivery, or pouring position and the major arc points towards the free delivery end of the lever. Whilst such an arrangement provides more overlap of the pins in the closed position of the lever and therefore a better seal than could be obtained with the first described arrangement, it sill does not reliably and at all times preclude partial disengagement of the lever from the latch slots. Furthermore, this device is more expensive owing to the complicated form of the bearing pins.

By contrast, it is the object of the present invention to provide a closure device which ensures a reliable seal but permits the provision of a structurally simple bearing system between the rocking lever and the cap part.

According to the invention there is provided a two-part delivery outlet closure device for containers, especially for liquids, comprising a cap part whereof the end wall is provided with a through bore leading into a recess which has two side walls wherein a rocking lever, which is likewise provided with an axial through bore, is pivotally mounted by means of a bearing system comprising a pair of bearing pins normal to the bores one on each side thereof and a pair of latch slots each adapted to receive one pin and open on one side and of narrower width in this region to the diameter of the bearing pin so that the pins are adapted to engage in the slots in the manner of a snap fastening, for which reason at least one part of the device is made of a resilient material, the bearing pins being arranged in the side walls of the cap part and the latch slots on the lever part.

With this arrangement, the bearing pins are fully overlapped by the upper webs of the latch slots when the lever occupies the closing position so that partial disengagement of the lever from the slots is safely prevented even in the presence of a very high pre-loading force between lever and cap part, and therefore an efficient and satisfactory seal for the bore in the cap part. At the same time, the bearing system which has been selected is extremely simple inasmuch as the pins may be of perfectly ordinary cylindrical form. Furthermore, the bearing system and disposition adopted by this arrangement makes for easy pivotting of the lever.

In a particularly advantageous arrangement, the latch slots extend parallel to the through bore in the lever. This means that the upper webs of the slots on the lever must always overlap or cover the bearing pins on the cap part when the device is closed. Moreover, this kind of bearing system is very simple and easy to manufacture and consequently cheap.

Another advantageous arrangement the bearing pins are comparatively short and engage not very deeply in the latch slots, and the distance between the frontal end of each pin and the axis of the through bore in the lever is greater than the diameter of the pin.

With these provisions, the bearing system between the lever and the cap part can be comparatively flexible if required whilst being capable, on the one hand, of transmitting a sufficiently strong bias force between lever and cap and, on the other hand, limiting such bias force to a value which is compatible with acceptable friction between these parts and will not give rise to excessive wear.

One embodiment of the delivery outlet closure according to this invention will hereinafter be more specifically explained and described by way of example with reference to the accompanying drawings wherein.

Figure 1:
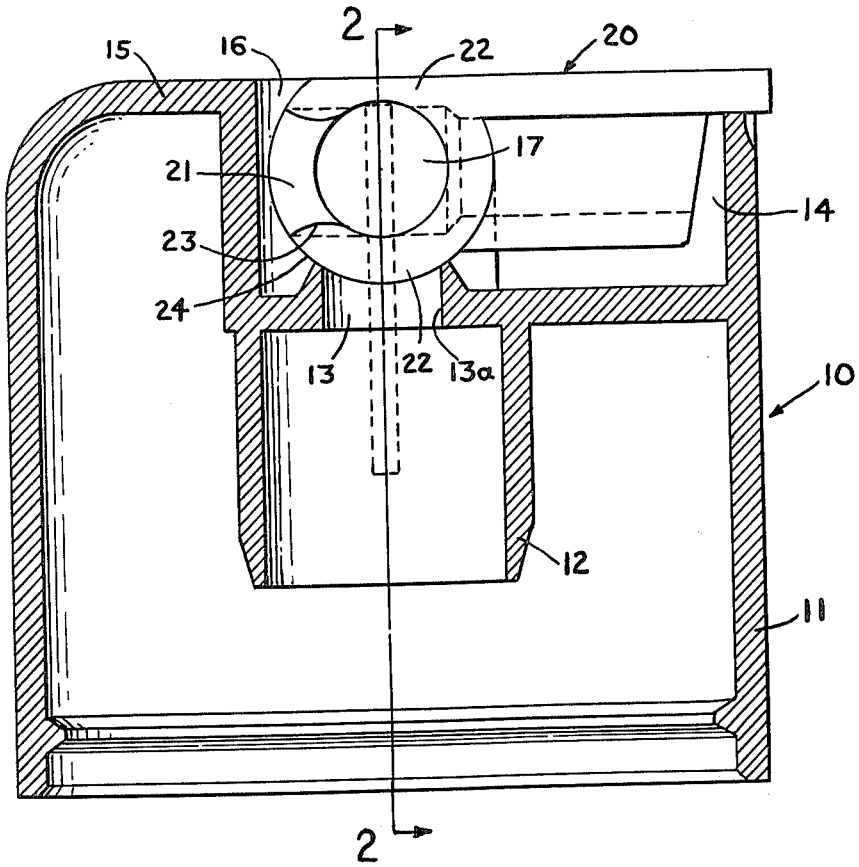
FIG. 1 is a fragmentary cross section through the closure device.

As shown in the drawings, the delivery outlet closure device comprises a cap part, generally designated 10 and a rocking lever, generally designated 20.

The cap part 10 essentially comprises an outer cap or cover part 11 and an inner or plug part 12 which communicates with a through bore 13 leading into a recess 14 provided in the end wall 15 of the cap 10. This recess 14 has twoside walls 16 each carrying a bearing pin 17. The bearing pins are in line and extend normal to the axis of the bore 13.

The rocking lever 20, which is also provided with an axial through bore 25, not specifically illustrated, is provided, at the end thereof which faces the bore 13 in the cap 10, with two latch slots 21, each defined by a pair of webs 22 extending parallel to the axis of the lever 20. In the region 23 of the open side of the slots 21 the width of the latter is narrower than the diameter of the bearing pins 17. Consequently the lever 20 with its slots 21 is pressed on to the bearing pins 17 in the manner of a snap-fastener device. Naturally, in order to permit such snap engagement at least one part of the closure device, that is to say, either the cap part 10 or the lever part 20 must be made of a suitable resilient material, such as a suitable plastics material.

The end of the lever 20 which faces the through bore 13 of the cap part 10 presents a region 24 of rotationally symmetrical form relative to the pivot axis so that when the lever is pivotally displaced, sealed engagement with an annular bead **13*a* provided at the end of the bore 13 facing the lever 20, is ensured at all times. The vertical position of the lever 20 wherein its axial bore is in line with the bore 13 in the cap part 10 represents the "open" position of the device whilst in the "closed" position of the device the lever extends substantially normal to the axis of the bore 13 in the cap part 10. In order to ensure, in this latter position of the lever, that the corresponding lever area will engage sealingly with the annular bead 13*a* of the cap bore 13, the lever 20 must be applied to the bead 13*a* under a suitable preloading force or bias. This bias is safely absorbed by the top webs 22 of the latch slots 21 on the lever 20 because these webs 22 completely cover the bearing pins 17** on the top side thereof. This ensures an efficient sealing effect for the closure device.

Figure 2:
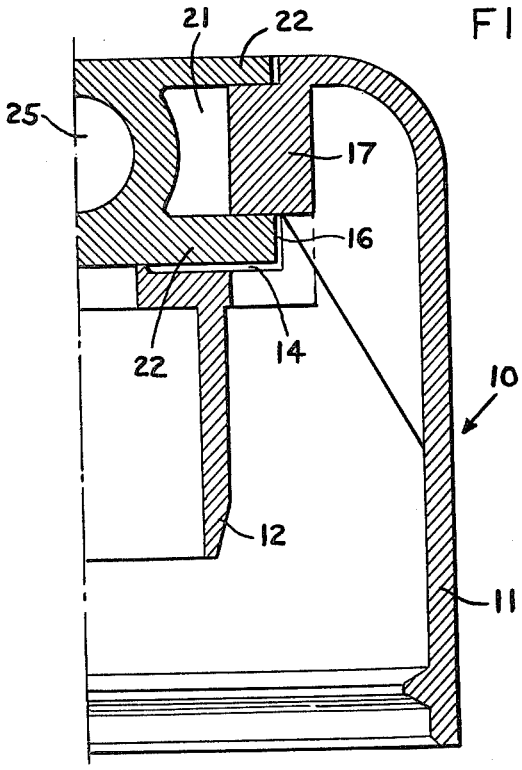
FIG. 2 is a section through the device taken on line II—II in FIG. 1.
Figure 3:
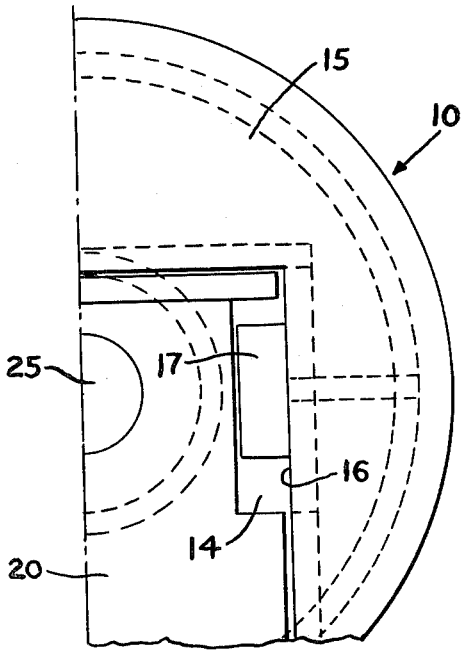
FIG. 3 is a fragmentary top view of the device.

It will be noted particularly from FIG. 2 that the bearing pins 17 at the side walls 16 of the cap part 10 are comparatively short and the depth of their engagement in the latch slots 21 of the lever 20 is not very great so that the distance between the frontal end of each pin 17 and the axis of the bore 25 in the lever 20 is greater than the diameter of the pin 17. This provided a comparatively flexible seating or mounting of the lever 20 on the bearing pins 17 which, whilst being capable of opposing the required strength to the bias between lever 20 and 10, nevertheless limits friction between the rotationally symmetrical part 24 on the lever 20 and the annular bead **13*a* of the cap part 10** to a value which is acceptable with regard to resulting frictional wear between the two parts.

What I claim is:

1. A two-part delivery outlet closure device for a container having an exterior and an interior and including a portion providing an opening from said exterior into said interior, said outlet closure comprising:

A. a cap part for being placed over and connected to said container portion providing said opening into said container interior, said cap part including:
   a. a first portion providing a cap interior for communicating with said container interior;
   b. a second portion including an end wall and a pair of opposed side walls, said walls providing a recess for receiving a rocking lever;
   c. a third portion providing:
      (i) a first axial through-bore extending between said cap interior and said recess and for communicating said cap interior with said recess, said first through-bore having an axis, and
      (ii) a generally annular bead surrounding the entrance of said first through-bore into said recess;
   d. A pair of opposed axially aligned and cylindrically shaped bearing pins, each pin provided on one of said side walls and extending into said recess, the axis of said bearing pins being normal to and intersecting said first through-bore axis, and said bearing pins having a diameter and being displaced a predetermined distance from said annular bead surrounding said first through-bore; and B. a pivotable rocking lever for residing in said recess and providing a second axial through-bore having an entrance end and an exit end and said rocking lever for being pivoted between open and closed positions, said rocking lever including:
   a. a first generally longitudinally extending portion through which said second axial through-bore extends, said first generally longitudinally extending portion provided with an end into which said exit end of said second axial through-bore opens,
   b. a second generally cylindrical portion normal to said first generally longitudinally extending portion and through which said second through-bore extends, said entrance end of said second through-bore opening into the outer surface of said second generally cylindrical portion, and said second generally cylindrical portion provided on the opposite ends thereof with a pair of interrupted, generally annular web portions providing a pair of latch slots the width of which is narrower than said diameter of said bearing pins, C. at least one of said cap part or said rocking lever being made of a predetermined resilient material whereby said bearing pins can be forced through said latch slots into said web portions of said rocking lever in the manner of snap-fastening, said bearing pins and said web portions providing a bearing system for permitting pivotal movement of said rocking lever with respect to said cap part between said opened and closed positions;

D. said latch slots being substantially parallel with said second through-bore extending through said rocking lever whereby upon said cap part being connected to said container portion providing said opening into said container interior and upon said rocking lever being pivoted into said closed position, said web portions and said bearing pins, due to said bearing pins being displaced said predetermined distance from said annular bead surrounding said first through-bore, force a predetermined portion of said second generally cylindrical portion of said rocking lever into sealing engagement with said annular bead surrounding said first through-bore to seal off said container interior from said container exterior, and, upon said rocking lever being pivoted into said open position, said first and second through-bores being aligned to communicate said container interior with said container exterior.

2. A two-part delivery outlet closure device according to claim 1 wherein said predetermined portion of said second generally cylindrical portion of said rocking lever for being forced into sealing engagement with said annular bead is comprised of a region of rotationally symmetrical form relative to said axis of said bearing pins to facilitate said sealing engagement between said second generally cylindrical portion of said rocking lever and said annular bead.

3. A two-part delivery outlet closure device according to claim 1 wherein said bearing pins are provided with opposed, frontal ends and wherein the distance between said frontal ends of said bearing pins and said axis of said second through-bore is greater than the diameter of said bearing pins whereby said bearing pins extend into said web portions a predetermined distance to provide flexible mounting of said rocking lever on said bearing pins to reduce friction therebetween, and thereby to reduce frictional wear of said predetermined portion of said second generally cylindrical portion of said rocking lever and said annular bead.

* * * * *